US006155738A

United States Patent [19]

King

[11] Patent Number: 6,155,738

[45] Date of Patent: Dec. 5, 2000

[54] LIPSTICK/COSMETIC PORTFOLIO

[76] Inventor: Tammye Lynn King, 3301 S. Hametown Rd., Norton, Ohio 44203

[21] Appl. No.: 09/004,773

[22] Filed: Jan. 9, 1998

Related U.S. Application Data

[60] Provisional application No. 60/037,086, Jan. 14, 1997.

[51] Int. Cl.[7] ..... B42F 13/00

[52] U.S. Cl. ..... 402/79; 206/455; 206/473; 206/772; 281/15.1; 281/22; 281/31; 281/34; 281/38; 283/67; 283/70; 283/74; 402/80 R

[58] Field of Search ..... 206/455, 772, 206/473; 281/31, 30, 38, 34, 28, 22, 15.1; 283/67, 70, 74; 402/79, 80 R

[56] References Cited

U.S. PATENT DOCUMENTS

| | | | |
|---|---|---|---|
| 3,930,700 | 1/1976 | Figueres | 402/79 |
| 4,629,070 | 12/1986 | Roberg | 402/79 |
| 4,848,576 | 7/1989 | Stemmer, Jr. | 206/455 |
| 5,377,733 | 1/1995 | Halley et al. | 206/455 |
| 5,466,008 | 11/1995 | Ozeki | 281/31 |
| 5,501,540 | 3/1996 | Ho | 402/79 |
| 5,647,941 | 7/1997 | Gunderman et al. | 156/277 |

*Primary Examiner*—Andrea L. Pitts
*Assistant Examiner*—Monica Smith

[57] ABSTRACT

An organizer includes sample cards which are mounted on pages which, in turn, are stored within a binder. Each of the sample cards bears a color sample and an associated written description for a particular cosmetic product.

14 Claims, 2 Drawing Sheets

LIPSTICK/COSMETIC PORTFOLIO

Claim priority of Provisional Application Ser. No. 60/037,086 filed Jan. 14, 1997.

FIELD OF THE INVENTION

The present invention relates to cosmetics and more particularly, to a system for organizing an inventory of cosmetics.

BACKGROUND OF THE INVENTION

A person's supply of cosmetics tends to accumulate over time, particularly in the case of lipstick, for example. As the number of acquired lipstick tubes increases, storage can become a problem, and finding the desired shade can become a hassle. Thus, a need exists for an inventory organizer which facilitates location of a desired lipstick color from among a large inventory of lipstick tubes.

SUMMARY OF THE INVENTION

The present invention provides methods and apparatus for organizing an inventory of lipstick or any other sort of cosmetic made available in a range of colors. In the preferred embodiment, a sample of each lipstick color and an appropriate written description are placed on a discrete card and stored in a common holder. A person may then simply scan all of the cards in the container to locate a desired shade of lipstick from among those on hand. The associated written description then facilitates location of the appropriate lipstick tube within the collection.

The present invention may be seen to be useful in assisting a person (a) to organize and maintain a customized portfolio of the lipsticks within a collection; and/or (b) to view and assess all of the available colors without handling all of the lipstick tubes within the collection. Some of the advantages of the present invention may be seen to include: (a) it is cost effective to manufacture; (b) it is simple to use; (c) it occupies relatively little space; (d) it allows comparison of lipsticks to clothes without exposing the latter to the former; and/or (d) it tends to eliminate waste which might otherwise result due to unintentional purchases of essentially identical shades of lipstick.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1A:
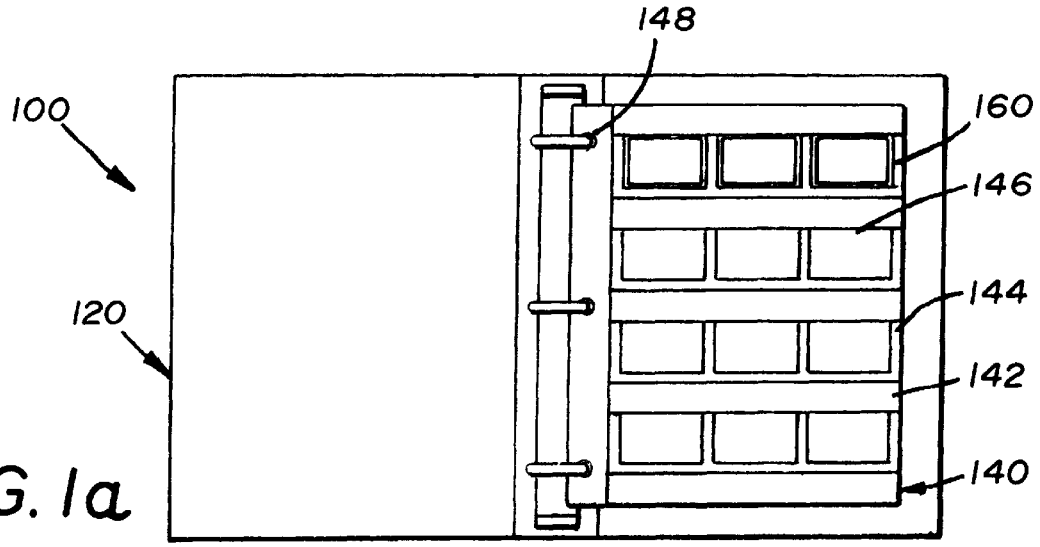
FIG. 1*a* is a top plan view of a preferred embodiment cosmetics organizer constructed according to the principles of the present invention, opened to a first type of page.
Figure 1B:
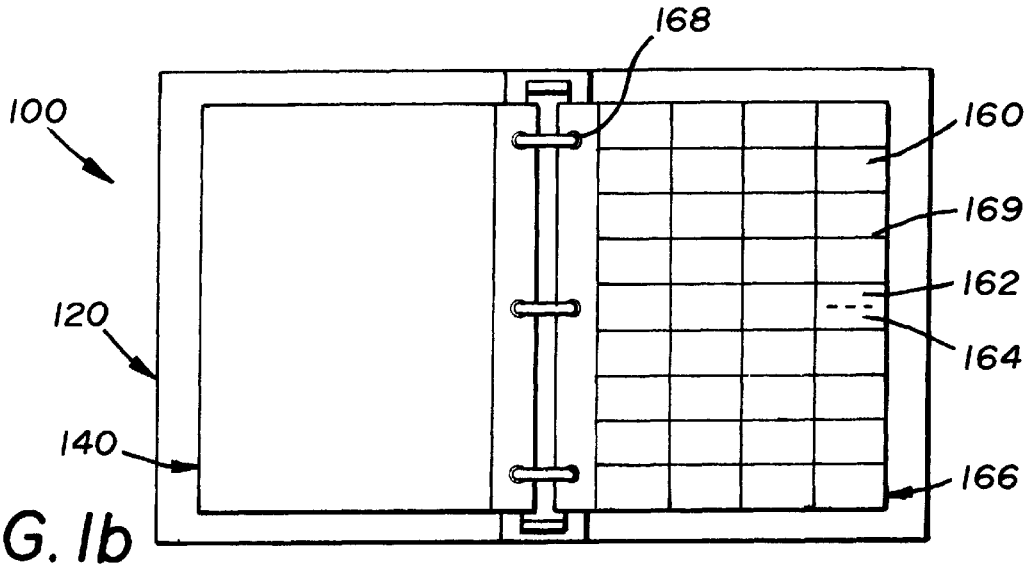
FIG. 1*b* is a top plan view of the organizer of FIG. 1, opened to a second type of page.
Figure 1C:
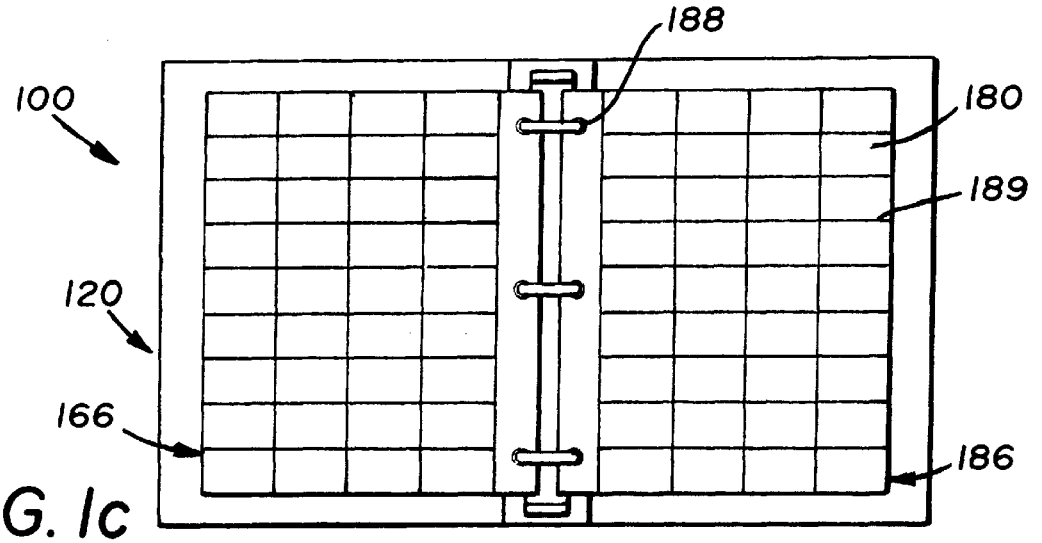
FIG. 1*c* is a top plan view of the organizer of FIG. 1, opened to a third type of page.

A preferred embodiment cosmetics inventory system constructed according to the principles of the present invention is designated as 100 in FIGS. 1*a*–1*c*. The system or kit 100 is designed to organize cosmetic samples in a manner that is neat and user friendly, eliminating the need to handle the cosmetics themselves in order to assess the inventory and/or locate a desired shade. The system 100 generally includes a binder or holder 120, pages or sheets 140, cards or plates 160, and covers or laminates 180.

Figure 2:
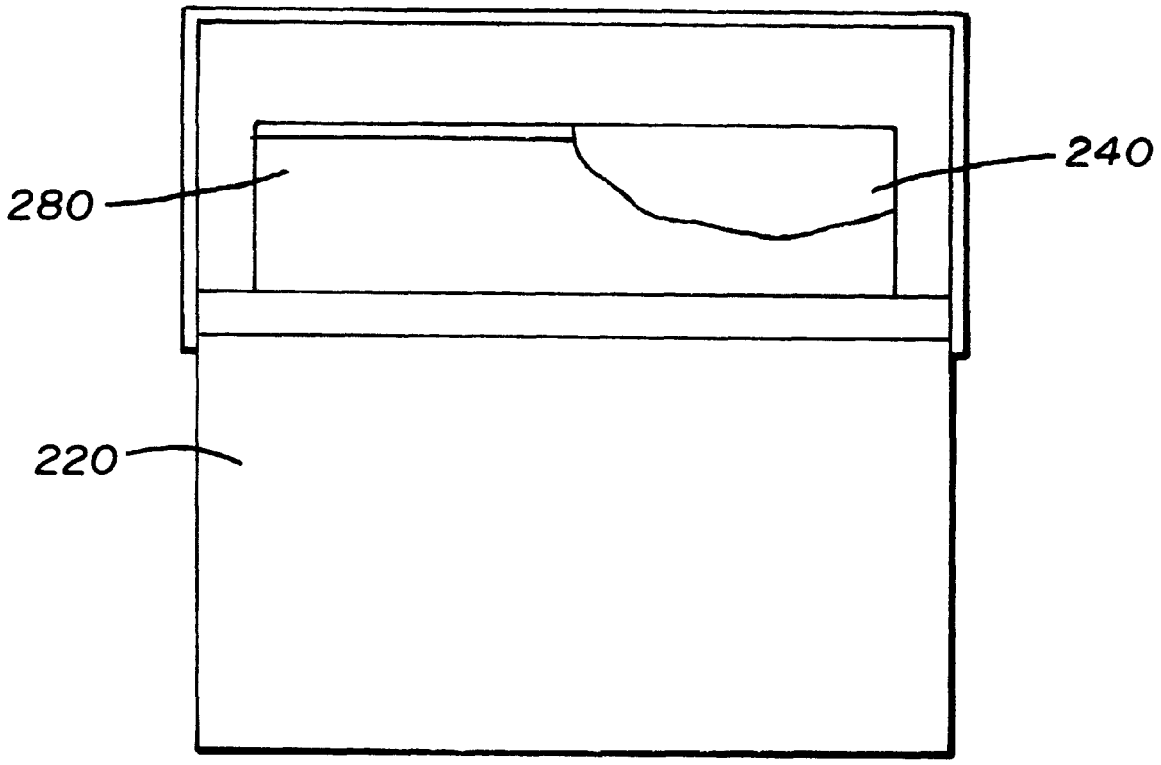
FIG. 2 is a front view of an alternative embodiment cosmetics organizer constructed according to the principles of the present invention.

The binder 120 is a type known in the art as a 3-ring binder. Although the specific binder 120 is well suited for this application, those skilled in the art will recognize that the present invention is not necessarily limited in this regard. For example, as shown in FIG. 2, a box 220 could be used instead of the binder 120 to hold the cosmetic samples.

The pages 140 are similar in some respects to those present in a certain type of known photo album. As shown in FIG. 1*a,* each of the pages 140 includes a white backing 142 and a plurality of clear, transparent covers or patches 144. Peripheral portions of the patches 144 are adhered to the backing 142 to define an array of pockets 146. Each of the pockets 146 is oriented to open in the same direction—upward. In the preferred embodiment, both the backing 142 and the patches 144 are made of plastic. Along a side of each page 140, holes 148 are formed through a reinforced strip to facilitate storage of each page 140 in the binder 120. Although the pages 140 are well suited for this application, those skilled in the art will recognize that the present invention is not necessarily limited in this regard. For example, as shown in FIG. 2, index cards 240 could be used instead of the pages 140 to hold the samples.

The cards 160 are preferably made from white card stock and are sized and configured to slide into the pockets 146. As shown in FIG. 1*b,* the cards 160 provide a first area 162 suitable for receiving a color sample (of lipstick, for example), and a second area 164 suitable for receiving an appropriate written description of the color sample (Chanel Coco Burgundy, for example). Blank cards 160 are stored in sheet form within the binder 120 until needed for insertion into the inventory list. Along a side of each sheet 166, holes 168 are formed through a reinforced strip to receive the rings of the binder 120. Perforations 169 extend between the cards 160 to facilitate separation of each individual card 160 from the sheet 166.

The covers 180 are preferably made from clear plastic and sized and configure to overlie the cards 160. A clear adhesive on one side of the covers 180 temporarily secures them to backing material and subsequently secures them to respective cards 160. As shown in FIG. 1*c,* the covers 180 are stored in sheet form within the binder 120 until needed for covering a newly added card 160. Along a side of each sheet 186, holes 188 are formed through a reinforced strip to receive the rings of the binder 120. Perforations 189 extend between the covers 180 to facilitate separation of each individual cover 180 from the sheet 186.

Once a color sample and a written description have been applied to the face of an individual card 160, a cover 180 is secured over the face of the card 160 to protect same. The interconnected card 160 and cover 180 are then placed into one of the pockets 146 for future reference. Although the cards 160 and the covers 180 are well suited for this application, those skilled in the art will recognize that the present invention is not necessarily limited in this regard. For example, as shown in FIG. 2, an overlying transparency 280 could be used together with the index card 240 in lieu of both.

Those skilled in the art will also recognize that the present invention may lead cosmetics manufacturers to offer pre-printed cards together with their lipstick to facilitate use of the present invention. In such an event, the pre-printed card would simply be inserted into one of the pockets 146 upon acquisition of the lipstick associated therewith.

The present invention may also be seen to provide methods of organizing a cosmetics inventory. For example, a person can organize a lipstick inventory by depositing a sample of each available lipstick on a separate card together with an appropriate written description; and placing each sample card in a common holder. In a preferred method, each card is sealed and then disposed within one of several pockets on any of several pages disposed within a binder.

Although the present invention has been described with reference to particular embodiments and applications, those skilled in the art will recognize additional embodiments and/or applications which fall within the scope of the present invention. Accordingly, the scope of the present invention is to be limited only to the extent of the claims that follow.

What is claimed is:

1. A cosmetics organization kit, comprising:

a holder;

at least one page sized and configured to be releasably secured within the holder;

a plurality of transparent patches secured to at the least one page to define a plurality of pockets;

a plurality of cards sized and configured to fit within respective pockets, wherein each of the cards is also sized and configured to provide a first region suitable for receiving a color sample, and a second region suitable for receiving a written description of a color sample;

a plurality of transparent, adhesive-backed sheets, pre-sized to fit over a respective color sample card, wherein, after a color sample and written description has been placed on a card, the user peels off one of the pre-sized, transparent adhesive-backed sheets and places it over the card with the adhesive backing facing downward towards the color sample.

2. The kit of claim 1, wherein the cards are provided in sheets which are sized and configured to be releasably secured within the holder, and perforations are formed in the sheets to facilitate removal of each of the cards.

3. The kit of claim 2, further comprising a plurality of transparent, adhesive-backed sheets pre-sized and configured to overlie respective cards and thereby cover respective color samples and written descriptions.

4. The kit of claim 3, wherein the transparent, adhesive-backed sheets are pre-sized and configured to be releasably secured within the holder, and perforations are formed in the transparent, adhesive-backed sheets to facilitate removal of each of the sheets.

5. The kit of claim 4, wherein the holder is a ring binder.

6. The kit of claim 1, wherein the holder is a ring binder.

7. The kit of claim 6, wherein the cards are provided in sheets which are sized and configured to be releasably secured within the ring binder, and perforations are formed in the sheets to facilitate removal of each of the cards.

8. The kit of claim 1, further comprising a plurality of transparent adhesive-backed sheets pre-sized and configured to overlie respective cards and thereby cover respective color samples and written descriptions.

9. A method of organizing an inventory of different cosmetics, comprising the steps of:

applying a color sale of one cosmetic to a card;

applying an appropriate written description to the card;

peeling the back off one of the transparent, adhesive-backed sheets and placing the sheet over the card with the adhesive back facing downward towards the color sample;

placing the card in a holder; and repeating the foregoing steps for each remaining cosmetic within the inventory.

10. The method of claim 9, further comprising the step of adding a new cosmetic to the inventory.

11. The method of claim 9, further comprising the step of removing a card for the new cosmetic from a perforated sheet of cards.

12. The method of claim 9, further comprising the steps of applying a sample of the cosmetic to the card; and writing a description of the cosmetic on the card.

13. The method of claim 9, further comprising the step of peeling a pre-sized, transparent, adhesive-backed sheet off of a larger perforated sheet and placing the sheet over the card with the adhesive-backed side facing downward towards the color sample.

14. The method of claim 9, further comprising the steps of inserting the card into a respective pocket on a respective page; and releasably securing the respective page within a binder.

* * * * *